US008905012B2

(12) United States Patent
Zafer

(10) Patent No.: US 8,905,012 B2
(45) Date of Patent: Dec. 9, 2014

(54) HIGH-POWER PNEUMATIC WEAPON SYSTEM

(75) Inventor: Yigit Zafer, Istanbul (TR)

(73) Assignee: Atak Silah Sanayi ve Ticaret Limited Sirketti, Uemraniye/Istanbul (TR)

( * ) Notice: Subject to any disclaimer, the term of this patent is extended or adjusted under 35 U.S.C. 154(b) by 0 days.

(21) Appl. No.: 13/378,714

(22) PCT Filed: Jun. 16, 2009

(86) PCT No.: PCT/TR2009/000076

§ 371 (c)(1),
(2), (4) Date: Dec. 16, 2011

(87) PCT Pub. No.: WO2010/147565

PCT Pub. Date: Dec. 23, 2010

(65) Prior Publication Data

US 2012/0125305 A1 May 24, 2012

(51) Int. Cl.
*F41B 11/28* (2006.01)
*F41B 11/683* (2013.01)

(52) U.S. Cl.
CPC ..... *F41B 11/683* (2013.01)
USPC ..... 124/65; 124/60; 124/63; 124/64; 124/70

(58) Field of Classification Search
USPC ..... 102/61, 63, 64, 65, 67, 69, 70, 73; 124/61, 63, 64, 65, 67, 69, 70, 73; 42/135, 136, 138
See application file for complete search history.

(56) References Cited

U.S. PATENT DOCUMENTS

| | | | | | |
|---|---|---|---|---|---|
| 1,214,398 | A | * | 1/1917 | Welch | 124/69 |
| 1,516,483 | A | * | 11/1924 | Krafft | 124/69 |
| 1,545,465 | A | * | 7/1925 | Johnstone et al. | 124/67 |
| 2,115,041 | A | | 4/1938 | Alejandro | |
| 2,119,441 | A | * | 5/1938 | Price | 124/69 |
| 2,299,073 | A | * | 10/1942 | Beasley | 124/69 |
| 2,306,668 | A | * | 12/1942 | Stevens | 124/67 |
| 2,450,029 | A | * | 9/1948 | Wells | 124/69 |
| 3,233,601 | A | * | 2/1966 | Fritz | 124/69 |
| 3,308,803 | A | * | 3/1967 | Fritz | 124/69 |
| 3,342,171 | A | * | 9/1967 | Ryan et al. | 124/55 |
| 3,385,279 | A | * | 5/1968 | Pitcher | 124/67 |
| 3,757,634 | A | | 9/1973 | Uria et al. | |
| 3,810,455 | A | * | 5/1974 | Garmon, Jr. | 124/69 |
| 3,913,554 | A | * | 10/1975 | Pitcher | 124/67 |
| 4,304,213 | A | * | 12/1981 | Jereckos | 124/69 |
| 4,691,442 | A | * | 9/1987 | Center | 42/140 |
| 4,756,297 | A | * | 7/1988 | Sindel | 124/67 |

(Continued)

OTHER PUBLICATIONS

Zoraki M906 9MM P.A.K. Blank Gun on Its Way! Google Image Result for http://www.replicaairguns.com/storage/post-images/Zoraki%2520M90%2520Hand%, 1 page, May 21, 2013.

(Continued)

*Primary Examiner* — Bret Hayes
*Assistant Examiner* — Derrick Morgan
(74) *Attorney, Agent, or Firm* — ARC IP Law, PC; Joseph J. Mayo

(57) ABSTRACT

This invention relates to "high-power pneumatic weapon system". It is the weapon shooting by means of compressed air, having double pistons engaged each other, fore-sight with multiple adjustments and rotatable around its own axis, and mechanism for releasing excessive air, of which the trigger tightens up after shooting.

4 Claims, 6 Drawing Sheets

(56) References Cited

U.S. PATENT DOCUMENTS

| | | | | |
|---|---|---|---|---|
| 4,834,059 | A * | 5/1989 | Moorhouse et al. | 124/67 |
| 5,129,172 | A | 7/1992 | Brennan | |
| 5,341,790 | A * | 8/1994 | Ebert | 124/69 |
| D359,098 | S | 6/1995 | Stevens | |
| 5,617,837 | A * | 4/1997 | Momirov | 124/73 |
| D387,841 | S | 12/1997 | Hochstrate et al. | |
| D387,842 | S | 12/1997 | Kaminski et al. | |
| 5,966,825 | A * | 10/1999 | Biemont | 42/136 |
| 5,975,068 | A * | 11/1999 | Halter et al. | 124/63 |
| D430,916 | S | 9/2000 | Bubits | |
| 6,343,598 | B1 * | 2/2002 | Pshenychny | 124/63 |
| D458,652 | S | 6/2002 | Chan | |
| D464,702 | S | 10/2002 | Mauch et al. | |
| D479,570 | S | 9/2003 | Scheunert | |
| 6,701,908 | B2 * | 3/2004 | Nibecker, Jr. | 124/69 |
| D505,475 | S | 5/2005 | Salva | |
| D505,476 | S | 5/2005 | McGarry | |
| D516,661 | S | 3/2006 | McGarry | |
| 7,273,047 | B2 | 9/2007 | Hu | |
| 7,287,526 | B1 * | 10/2007 | Bligh et al. | 124/63 |
| 7,290,539 | B2 | 11/2007 | Maeda et al. | |
| D559,337 | S | 1/2008 | Wang | |
| D574,053 | S | 7/2008 | McGarry | |
| D579,072 | S | 10/2008 | McGarry | |
| D583,896 | S | 12/2008 | McGarry | |
| D593,629 | S | 6/2009 | Bantle et al. | |
| D597,625 | S | 8/2009 | Pflaumer et al. | |
| D598,065 | S | 8/2009 | Vukovic et al. | |
| D599,430 | S | 9/2009 | Siddle et al. | |
| 7,603,996 | B2 | 10/2009 | Wei | |
| 7,726,293 | B2 | 6/2010 | Wei | |
| D627,028 | S | 11/2010 | Coulombier | |
| D650,880 | S | 12/2011 | McGarry | |
| D651,275 | S | 12/2011 | Emde et al. | |
| D654,978 | S | 2/2012 | Karanian et al. | |
| D671,610 | S | 11/2012 | Nebeker et al. | |
| 2003/0094167 | A1 * | 5/2003 | Nibecker, Jr. | 124/64 |
| 2003/0192521 | A1 * | 10/2003 | Nibecker, Jr. | 124/69 |
| 2004/0154599 | A1 * | 8/2004 | Nibecker, Jr. | 124/65 |
| 2005/0183709 | A1 * | 8/2005 | Marsac | 124/63 |
| 2010/0275491 | A1 | 11/2010 | Leiter et al. | |
| 2010/0299987 | A1 * | 12/2010 | Ballard | 42/136 |

OTHER PUBLICATIONS

Shark (Capa/Vamor) nevet kapta a szerelt gumis . . . , Google Image Result for http://fegyverlabor.com/images/zoraki-m-906-1, 1 page, May 21, 2013.

Nikita (2010) Season 1, Internet Movie Firearms Database—Guns in Movies, TV, and Video Games, retrieved from http://www.imfdb.org/wiki/Nikita_(2010)_-_Season_1 on May 21, 2013, 75 pages.

* cited by examiner

HIGH-POWER PNEUMATIC WEAPON SYSTEM

CROSS-REFERENCE TO RELATED APPLICATIONS

This application is a National Stage entry of International Application No. PCT/TR2009/000076 filed 16 Jun. 2009, wherein the contents of which are hereby incorporated herein by reference.

BACKGROUND OF THE INVENTION

1. Field of the Invention

Embodiments of the invention relate to a "high-power pneumatic weapon system". The weapon shoots by means of compressed air, and has double pistons, multiple fore-sight adjustments, wherein the trigger tightens up after shooting.

2. Description of the Related Art

There are currently weapons, such as rifles, guns and (Pre-Charged Pneumatic) PCP, operating by air system, i.e. shooting by means of compressed air. There are several systems for generating compressed air being used for these weapons, enabling the motion of bullet. The first one is the mechanism with spring and piston. It operates through the logic of activation of the weapon through the pull of trigger by a spring mechanism operating by the use of a lever or barrel at the side of the weapon as a crank. The air becoming highly compressed through the compression of high-volume air in front of the piston by activated spring mechanism reaches to the barrel and enables shooting pellets inside the barrel. Air weapons, called as PCP, use three different compressed air systems. Highly compressed air is transferred into the weapon by means of known compressed air cylinders, pumps or compressor being able to pump highly compressed air. For shooting while using them, the shooting range decreases or no shooting can be done when the air content inside the tube keeping the compressed air. Another air weapon structure being used today is pneumatic mechanism. For these mechanisms, the barrel, the lever located at the bottom, and the upper body of the weapon are used as crank. While the upper body opens, the air enters into the piston. While the upper body is being closed, the air filled in the weapon becomes compressed by compression. They have one single piston and they operate unidirectional. Opening of the upper body only allows for air filling. Most of them don't include an automatic safety system; however, the ones with automatic safety system have the latches located at the side of weapon. Since they don't have the feature of pumping backwards, they have one single and fixed fore-sight. Almost whole equivalent air guns and riffles are made of steel and its derivative materials. Some of them have adjustable trigger stop mechanism providing a resistance point after the trigger drops down. The air passages, reaching to the barrel from compressed air housing, have long and right angled turns. None of the equivalents have safety configuration releasing the excessive compressed air. Operating stand-alone, the sealing elements, such as gaskets, can be removed and replaced individually and they have one single release latch.

BRIEF SUMMARY OF THE INVENTION

In our invention, there is a safety mechanism positioned in front of the trigger, locking the trigger each time the upper body is opened or closed, which opens and closes to pump air. Since each pumping changes the shooting range, the fore-sight mechanism has multiple rotatable configurations. The trigger and hammer are made of soft and easily available metals, such as zamac, and they have mechanism with spring and flexible buffer for the absorption of shocks occurred during the operation of these parts. The compartment, where air is stored, is close to the barrel and has flat path. The sealing elements, such as gaskets, can be removed by a single spanner without removing any another mechanisms. Upper body release locks are positioned on both sides of the body. The structure of the spring and other elements of the trigger system allows for tightening up of the trigger after shooting. For pumping successively, there is a mechanism releasing the compressed air, which can challenge the system. The piston carries on compressing air while the upper body opens and closes. The structure of double pistons being one in another allows for obtaining highly compressed air. Air weapons composed of spring and piston cannot be set up successively (air filling). Since they cause high vibration during shooting, the target accuracy is low. Highly strong structure of spring and crank requires the use of tempered steel in trigger and piston mechanisms. This leads to the difficulties in processing of the materials, and increase on the costs. In order to obtain high shooting power, it requires a long crank, i.e. a barrel structure. This doesn't enable a weapon combination of high powered, but compact structure.

Since air weapons, known as PCP, can obtain the required compressed air only by means of auxiliary instruments, such as aqualungs, compressor or pumps being able to pump highly compressed air, a necessity to carry one of these instruments together with the weapon arises. Since the shooting range decreases when the air content inside the compressed tube becomes lower, the requested shooting accuracy cannot be provided. They also bring along the difficulties of continuous control of the compressed tube by means of a clock, and air filling during shootings. Since they reserve very high amount of air in air tubes within their structure, they tend to be explosive, which may cause injuries in cases, such as manufacturing defects and deformation. Carrying and using equipment such as pumps are time consuming and also tiring for the user. However, since the pneumatic models operate unidirectional with one single piston (air can be compressed while the upper body closes), they cannot provide high compression and shooting speed. The models with successive pumping tires the user since they require too much pumping in order to reach high speeds. Since pumping of the models with piston having large diameter by weak users is not possible at all, these types of users can only shoot by low-speed weapons. Since the said mechanism is located at the side of weapon in the models with automatic safety, it is not easy to access. The shooter realizes that the safety latch is locked only by pulling the trigger or checking the safety, so that the concentration is interrupted and time is wasted. As the models with multiple pumps don't have fore-sight adjusting mechanism suitable for the shooting range increasing according to the number of pumps, the ratio of hitting the target becomes lower. It requires almost continuously adjustment of rear-sight according to the same number of pumps and shooting according to this adjustment. Since the path, which compressed air is directed from air housing to the barrel, in all equivalent air weapons constitute of long and angular (angled) routes, losses in the compression and speed of the air occurs by also the effect of friction. This leads to losses in shooting range and power. They require removing various system parts for the replacement of valves and gaskets and they also have risk of causing mistakes while fitting. Since our invention is locked while the automatically opening and closing safety system pumps for shooting in high-power pneumatic weapon system, accidentally pulling of the trigger is prevented. As the safety is located in front of the trigger, the user can feel it on his/her fingertips without being have to check the safety. This allows for the release of the safety by finger without interrupting the concentration and shooting position. Since the shooting range changes according to the number of pumpings, fore-sight adjustment according to the shooting range is possible with multiple fore-sight adjustment. In this way, the ratio of hitting the target increases. It is possible to continuously shoot the same target with rear-sight adjustment. The parts composing the trigger and hammer system are made of soft materials, such as zamac, obtained by molding techniques, so that high accuracy and harmony between the parts, beside ease of manufacturing and decrease in costs are provided. Flexible springs and buffers are used in order to prevent these soft materials from crushing and abrading, and the lives of them are extended. With the mechanism absorbing the shocks occurring during the closing of upper body, opening and closing lock mechanism is also protected. Since the compartment, where air is stored, is so close to the barrel and has path, the compressed air is used more efficiently and high-speed shootings are made possible. Removing the gaskets and on/off valve by a single spanner without the need to remove any other parts provides easy replacement. As the compressed air is stored in a small area, risk of explosion occurring in case of manufacturing defect or deformation is prevented. The system parts are protected from deformation with the mechanism allowing for the release of excessive air. Fitting a stopper behind the trigger after the shooting is not required due to its structure composed of for trigger and hammer, and therefore stopper adjustment by the finger of user is not required. Unlikely other weapon systems, its trigger structure tightening up after shooting increases the shooting accuracy and the ratio of hitting the target. Since the opening and closing levers are on both sides, it makes use of the weapon by children or unconscious people difficult. The volume advantage of large piston is integrated with the compression advantage of small piston with structure of double pistons operating one in another. During opening and closing (pumping), manpower is used in the most efficient manner since the piston can compress air bidirectionally. Even by one pumping, much more shooting output speeds are obtained without reaching the power limit spent with other weapons. With check valve mechanism, successively pumping and reaching higher speeds are enabled.

BRIEF DESCRIPTION OF THE DRAWINGS

For better explanation of the invention.

Figure 1:
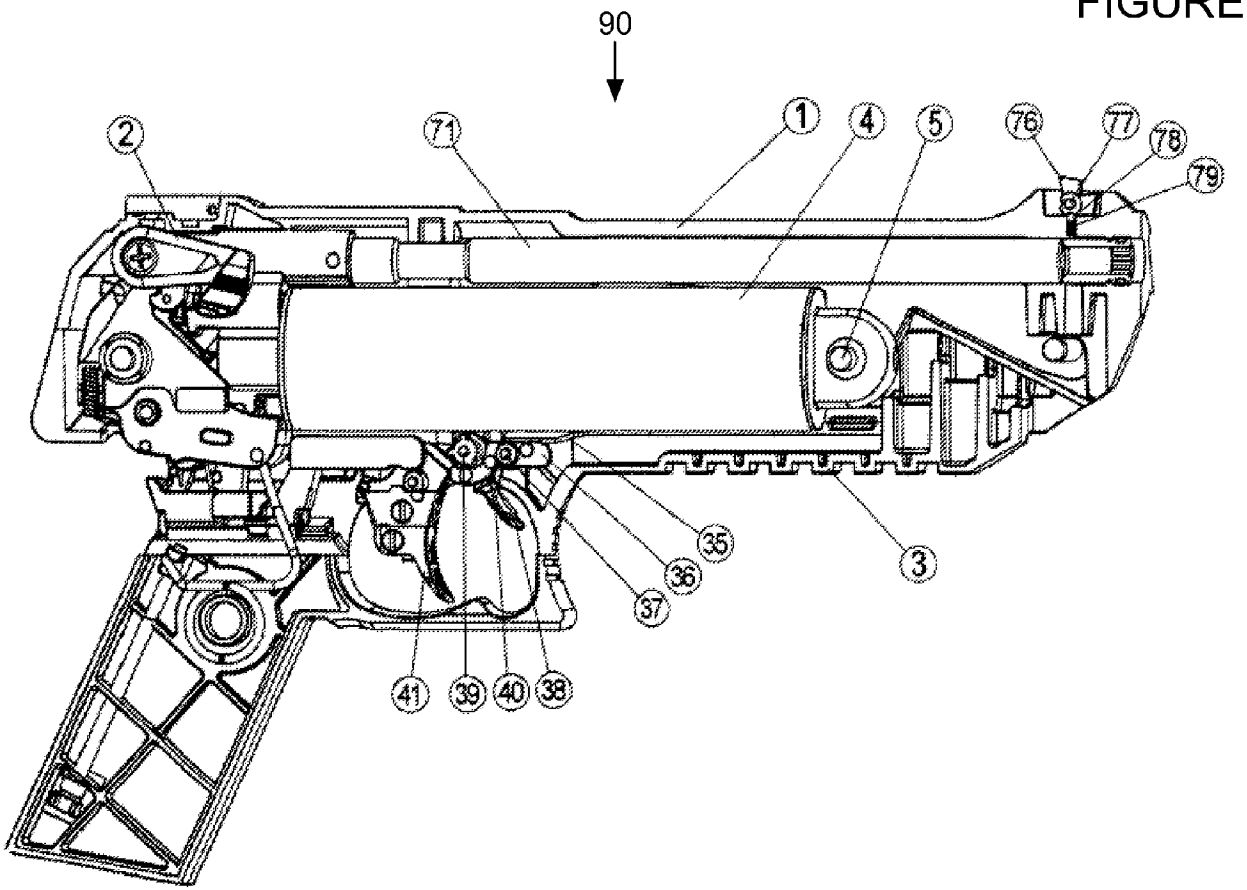
In FIG. 1; general view of the weapon.

1) upper body
2) opening levers
3) lower body
4) piston group
5) piston rod shaft
6) large piston compression section
7) small piston compression section
8) air inlet hole
9) first inlet hole
10) piston shaft
11) small piston pipe
12) small piston
13) piston o-ring
14) small piston screw
15) rear cap seal
16) rear cap o-ring
17) outer seal of large piston
18) inner seal of large piston
19) air centralized group
20) joint pipe
21) hammerü
22) hammer nose
23) disconnector
24) hammer nose spring
25) disconnector pin
26) hammer nose pin
27) hammer pivot pin
28) release locks
29) lock springs
30) lock rest surface
31) hammer rest surface
32) lifter spring pistons of hammer
33) hammer springs
34) hammer lifters
35) safety lock spring
36) safety lock
37) safety lock pin
38) safety lever
39) safety lever pin
40) safety spring
41) trigger group
42) front puller
43) rear puller
44) puller adjusting screw
45) joint pin
46) air compression compartment
47) relief nozzle o-ring
48) relief nozzle
49) relief gasket
50) relief piston
51) relief spring
52) relief screw
53) relief adjusting screw
54) check valve pin
55) check valve spring
56) check valve pin o-ring
57) check valve body
58) check valve rear o-ring
59) check valve front o-ring
60) trigger spring
61) trigger pin
62) trigger adjusting screw
63) trigger spring nut
64) valve rod
65) valve rod knob
66) valve buffer
67) valve spring
68) valve o-ring
69) output nut
70) barrel o-ring
71) barrel
72) valve rod nut
73) nut o-ring
74) valve rod seal
75) valve washer
76) multiple fore-sight
77) fore-sight pin
78) fore-sight ball

79) fore-sight spring
80) large piston pipe
81) large piston ring
82) lubrication felt
83) large piston
84) small piston seal
85) back cap
86) shaft front screw
87) piston lever pipe
88) pipe front cap
89) front cap o-ring
90) high-power pneumatic weapon

DETAILED DESCRIPTION OF THE INVENTION

Figure 2:
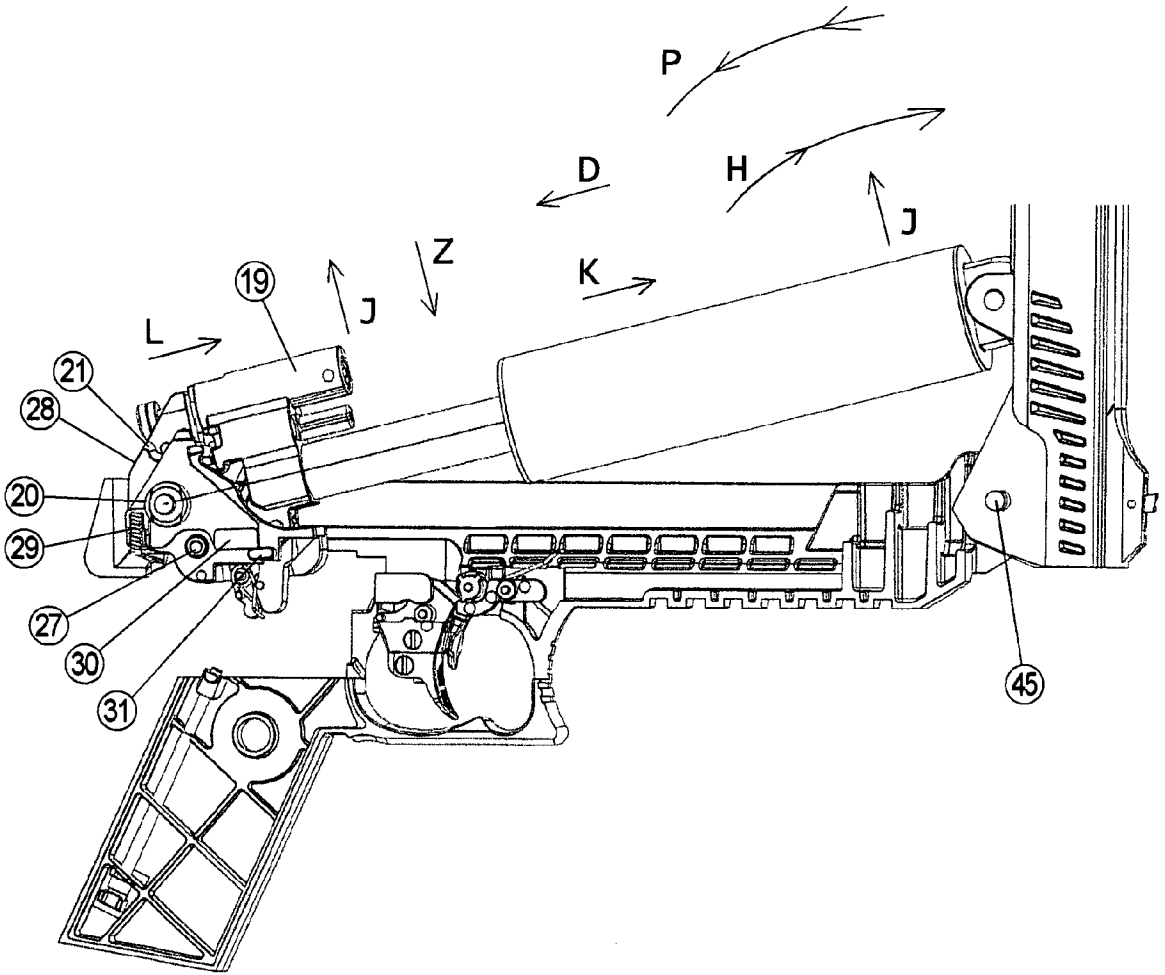
In FIG. 2; detailed view for return of the hammer.
Figure 3:
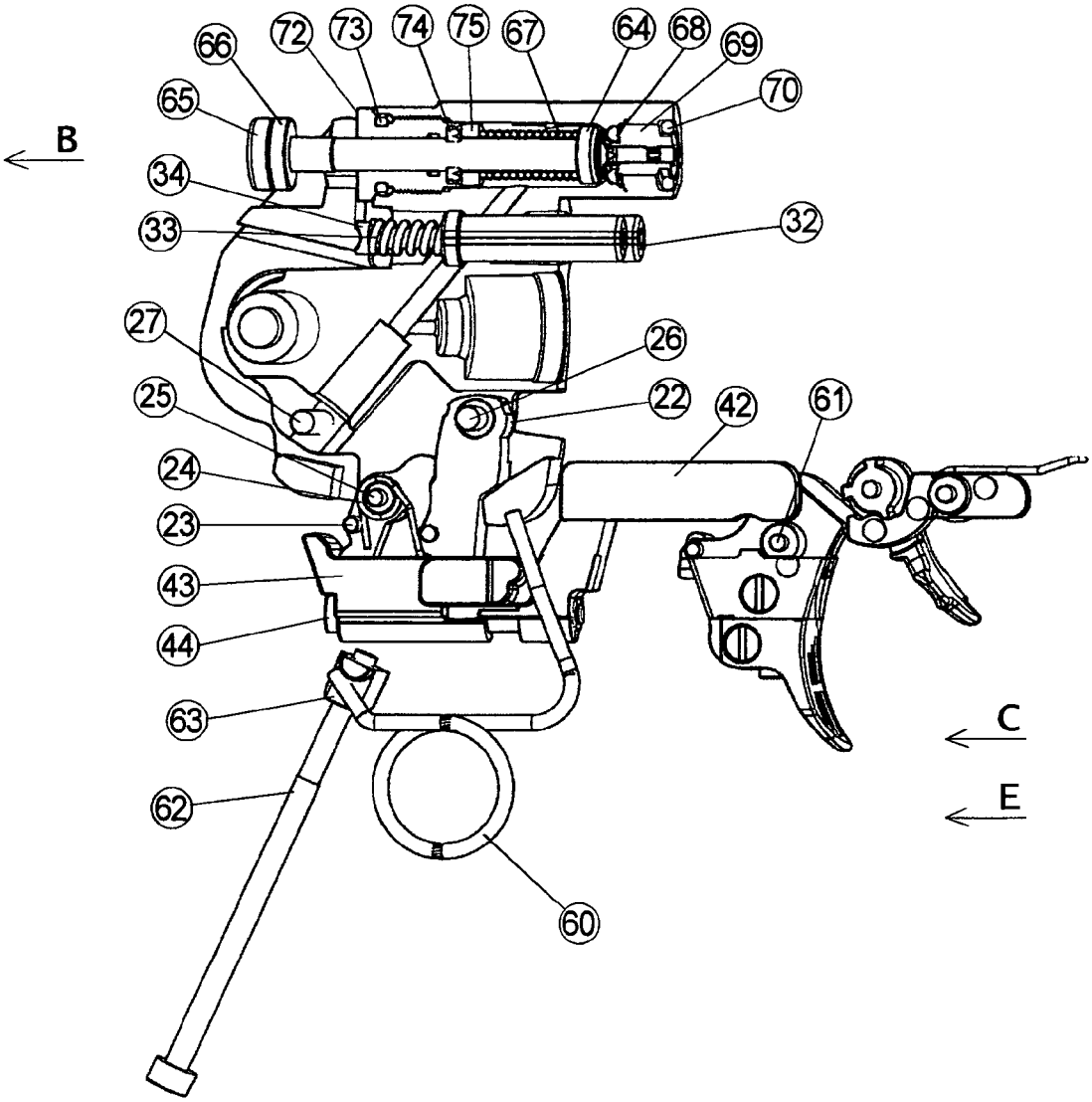
In FIG. 3; detailed view of trigger group.
Figure 4:
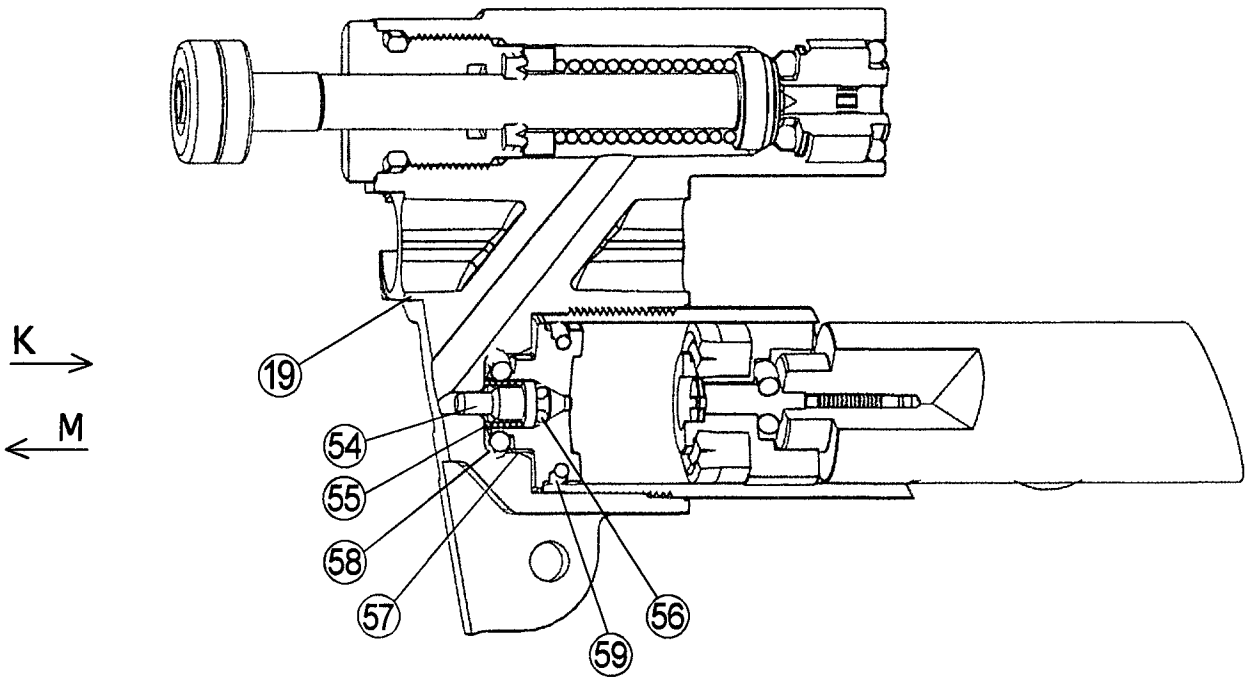
In FIG. 4; detailed view of check valve section.
Figure 5:
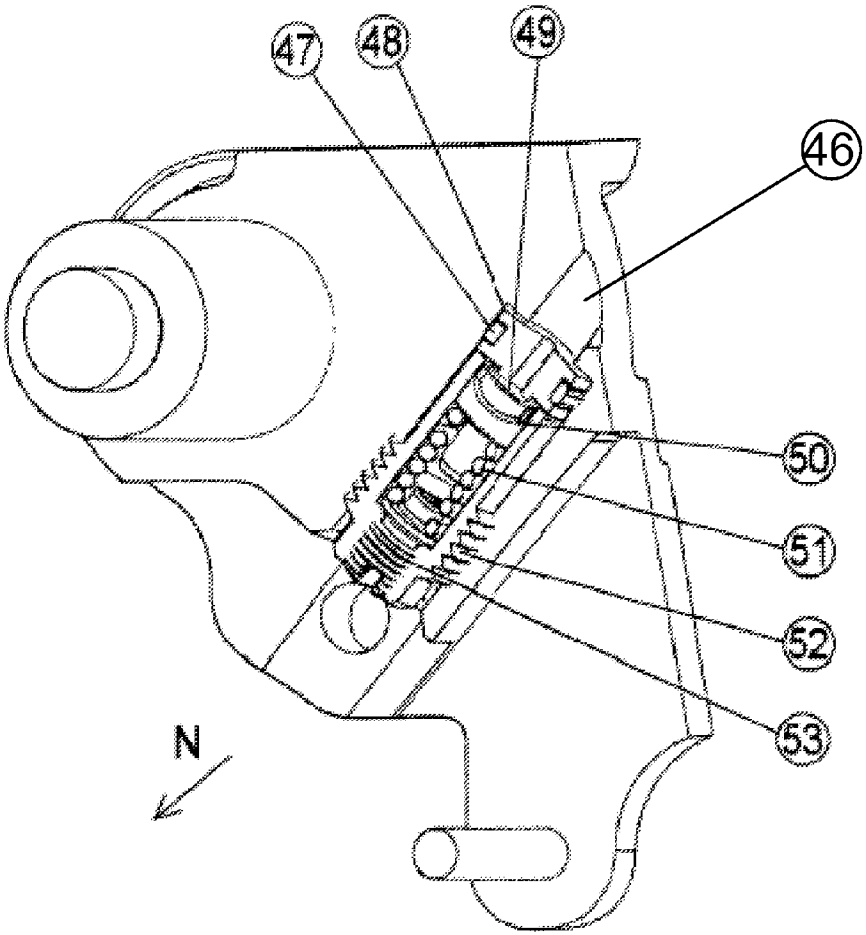
In FIG. 5; detailed view of compression releasing section.
Figure 6:
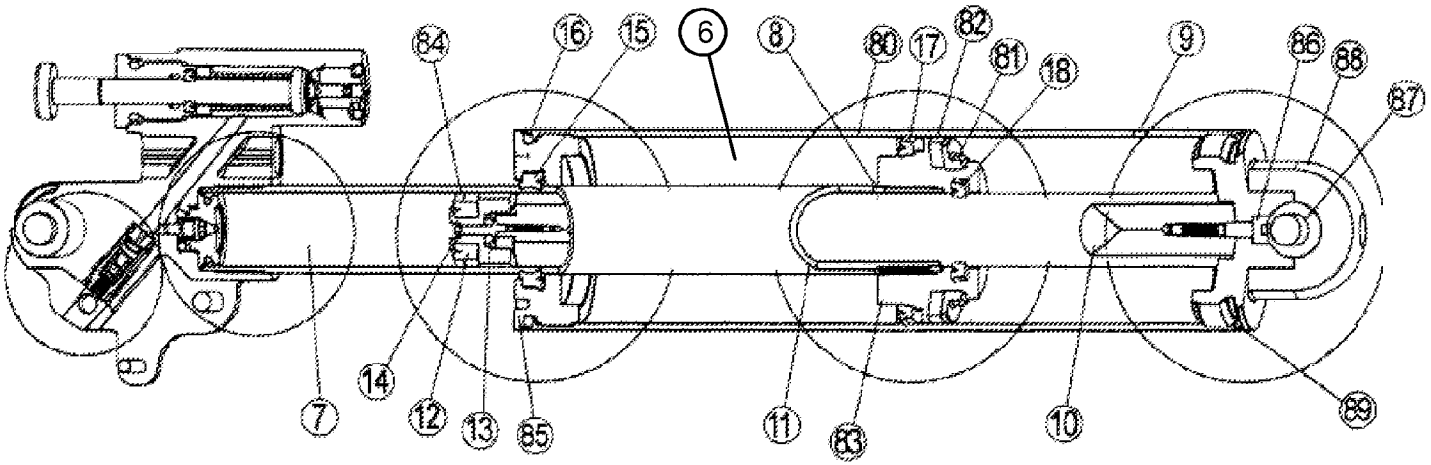
In FIG. 6; detailed view of piston group are given, and the reference numbers of the parts been used and their description are as follows.

As shown in FIG. 1, and FIG. 2, when opening levers (2) are pulled up, upper body (1) rotates about joint pin (45) thus enabling upper body (1) to separate from the lower body (3) in direction "H", as upper body (1) and lower body (3) are connected axially and with mobility capability. In the meantime, air at atmospheric pressure, is delivered to large piston compression section (6) within piston group (4) from first inlet hole (9) as shown in FIG. 6. With the motion of upper body (1) in the H direction, the piston group (4) connected thereto via piston rod shaft (5) also starts to extend in K direction as shown in FIG. 2. The air begins to compress within the large piston compression section (6) as the air passes through air inlet hole (8) and the distance between small piston (12) and piston shaft (10) increases. Air continues passing through the opening between outer diameter of small piston shaft (10) and inner diameter of small piston pipe (11). By air passage through inner diameter of piston o-ring (13), outer diameter of small piston screw (14), inner diameter of small piston (12), and afterwards, small piston compression section (7) starts to be filled with air. The parts forming the piston group (4) are built in large piston pipe (80). The pipe front cap (88) rear cap (85) are fixed by being screwed to large piston pipe (80), and pipe front cap (89) and back cap o-ring (16) enables sealing. Shaft front screw (86) couples the piston shaft (10) and pipe front cap (88) in a fixed manner. Piston lever pipe (87) located inside pipe front cap (88) and outside the piston rod shaft (5) increases the surface area of pipe front cap (88), and protects it from being crushed during operation and allows it to be of soft materials like plastic. The lubrication felt (82) located on large piston (83) by means of large piston ring (81) stores the lubricant required by piston group (4) due to friction. The small piston pipe (11) forms the outer perimeter of small piston compression section (7), while forming the inner perimeter of large piston compression section (6). Furthermore, it serves as shaft for the motions of large piston (83). While small piston compression section (7) continues to be filled with air, the motion of piston group in K direction allows the hammer lifter spring pistons (32) and consequently the hammer springs (33) therein to be released. In other words, blocking of motion of hammer (21) in H direction is also prevented. While the piston group (4) moves in K direction, piston group (4) and air centralized group (19) moves in J direction with being joint pipe (20) centralized and axially. This motion activates the hammer pivot pin (27) on air centralized group (19) and the hammer (21) with bearing and mobility capability towards J direction. After moving in J direction for a certain period of time, the motion in J direction is urged to stop by the contact of hammer rest surface (31) of hammer to lock rest surface (30) of release locks (28) and the motion of hammer (21) with axis of lock rest surface (30) starts. In other words, the motion of hammer (21) in J direction turns into motion in L direction. This means that the hammer (21) reaches pre-shooting position. When the motion of hammer (21) in L direction is over, the lock springs (29) stretch and absorb the excessive of motion of air centralized group (19) in J direction. In this way, the hammer (21), which reached pre-shooting position, gets away from the hammer nose (22). The hammer nose (22) and disconnector (23) mounted on air centralized group (19) return back to their original positions, i.e. pre-shooting position, due to the force of hammer nose spring (24) they use jointly, and thereby locking the hammer (21). While the hammer nose (22) is mounted with the axis of hammer nose pin (26) and with mobility capability, the disconnector is mounted with the axis of disconnector pin and with mobility capability. The motion of upper body (1) in H direction continues as long as the length of piston group (4) allows for. The piston group (4), fully extended in K direction, compresses whole air in large piston compression section (6) and delivers it to the small piston compression section (7). The volumetric ratio of small piston compression section (7) to the large piston compression section (6) determines the pressure of small piston compression section (7) at that time. The safety lock spring (35) located under the piston group (4) loses power by the motion of piston group (4) and air centralized group (19) in J direction. The safety lock pin (37) connected to the safety lock spring (35) rotates with the axis of safety lock pin and releases the safety lever (38) with the axis of safety lever pin (39). Due to the effect of the force of safety spring (40), the safety lever (38) rotates towards trigger group (41) at a certain angle and locks trigger group (41). As a result of abovementioned motions, briefly, the hammer (21) returns back pre-shooting position and it is locked; the trigger group (41) is secured by being locked via safety lever (38), and the air compressed inside large piston compression section (6) is stored in small piston compression section (7). Due to the force of friction, the distance between small piston (12) and piston shaft is covered by the motion of upper body in P direction, and piston o-ring (13) enables sealing. In other words, small piston (12) serves almost a check valve, and in order to compress and store the air compressed inside the small piston compression section (7) of piston group (4) in air compression compartment (46) of air centralized group (19) by folding, the motion of upper body (1) with the axis of joint pin (45) in P direction starts. While the piston group (4) and air centralized group (19) moves in Z direction as the upper body (1) is pushed in P direction, the piston group (4) also moves in D direction. To the end of the motion of upper body (1) in P direction and the motion of piston group (4) in D direction, the piston group (4) contacts and pushes hammer lifter spring pistons (32), thereby compressing the hammer springs (33) between hammer (21) locked by hammer nose (22) and the hammer lifter spring pistons (32). Disconnector (23) mounted on air centralized group (19) moving in Z direction reaches suspended position by resting on rear puller (43). When the upper body (1) with the axis of joint pin (45) covers lower body (3), the opening levers (2) are positioned in release locks (28), so that the upper body (1) and lower body (3) become integrated. In the meantime, air inside the small piston compression section (7) pushes the check valve pin (54) and check valve o-ring (56) in M direction by overcoming the force of check valve spring (55), and compresses the air into air centralized group (19). This compression process continues until the pressure between small piston compression section (7) and air compression compartment (46) is equalized. When said pressure is equalized, check valve pin (54) and check valve o-ring (56) return back to their original positions due to the force of check valve spring (55). Following the return of check valve o-ring (56) to its original position, the air tightness is provided. Check valve rear o-ring (58) and check valve front o-ring (59) provide the sealing air tightness between air centralized group (19) and piston group (4). Check valve body (57) incorporates the parts forming the check valve. In case that the shooter requests higher shooting power, air is pumped inside air compression department (46) inside air centralized group (19) by opening and closing upper body (1) with the axis of joint pin (45) in H and P directions. In each pumping, check valve pin (54) and check valve o-ring (56) perform the opening and closing motions in M and K directions, and desired number of pumpings are done. As a result of these repeated pumpings, the excessive air compressed in air centralized group (19) passes through relief nozzle (48) and pushes the relief gasket (49) and the relief spring (51), wherein the relief piston (50) is connected, in N direction, and after passing through relief adjusting screw (53) and relief spring (51), it is released to outer environment. Relief nozzle o-ring (47) and relief gasket (49) provides air tightness for the release section of air centralized group (19). The relief adjusting screw (53) is used for the adjustment of air compression, i.e. for adjusting the shooting power of high-power pneumatic weapon (90). High-power pneumatic weapon (90) with its air compression compartment (46), wherein the air tightness is provided by means of nut o-ring (73), valve rod seal (74), valve o-ring (68) and barrel o-ring (70), filled with air is ready for shooting. The trigger group (41) locked by means of safety lever (38) is released when safety lever (38) is pushed manually. The trigger group (41) pulled in C direction moves the rear puller (43) integrated with the front puller (42) mounted thereto and the puller adjusting screw (44) in E direction by moving with the axis of trigger pin (61). Disconnector (23) with axis of disconnector pin (25) contacting rear puller (43) rotates and gets away from the hammer nose (22). The hammer (21) being continuously under the pressure of hammer springs (33) transfers the same pressure force to the hammer nose (22). As a result of said pressure, the hammer nose (22) with its front side cleared moves away from the hammer (21) and it is released. Disengaged hammer (21) rotates in B direction at a specific angle due to the force of hammer springs (33) with being hammer pivot pin (27) centralized. Afterwards, it hits to valve rod (64) continuously applying pressure on valve o-ring (68) by the force of valve spring (67), and the valve rod knob (65) attached thereto and the valve buffer (66). In the meantime, the distance between valve rod (64), wherein the valve rod nut (72) serves as bearing, and the valve o-ring (68) increases. When compressed air at high speed passing through the output nut (69) and barrel o-ring (70) reaches barrel (71), the bullet inside barrel (71) is thrown at high speed. Valve buffer (66) is located between valve rod knob (65) and hammer (21), and protects them from deformation. When trigger group (10) is released after shooting, the trigger group (41), front puller (42), rear puller (43) and puller adjusting screw (44) return back to their pre-shooting positions by the force of trigger spring (60). The pressure of trigger group (41) is adjusted by tightening and loosening the trigger adjusting screw (62) attached to one lever of trigger spring (60) and screwed to trigger spring nut (63) by means of a spanner. The output nut (69) carries barrel o-ring (70) and valve o-ring (68), and allows for their replacement. Multiple fore-sight (76) attached to the upper body (1) by means of fore-sight pin (77) remains fixed at desired position by centering of fore-sight ball and by the force of fore-sight spring (79). Multiple fore-sight (76) is able to rotate at the position where the axis of fore-sight pin (77) is found. Multiple fore-sight (76), which the second adjustment level (see element 76*a*), is set by second pumping, enables shooting at the same point and thus does not require rear-sight adjustment.

What is claimed is:

1. A high-power pneumatic weapon system comprising:

an upper body (1);

a rear sight coupled to a top portion of the upper body (1);

a barrel (71) housed in upper body (1);

a lower body (3);

a joint pin (45) axially coupled with said upper body (1) and said lower body (3);

a piston group (4) coupled with said lower body (3) wherein said piston group is configured to compress air during both opening and closing of said upper body and said lower body wherein said piston group comprises:

a piston rod shaft (5) coupled with said piston group (4) wherein said piston rod shaft (5) is coupled with said upper body (1);

a large piston compression section (6) within said piston group (4);

a small piston (12) within said piston group (4);

a small piston compression section (7) having an air inlet hole (8);

a small piston shaft (10) having an opening between an outer diameter of said small piston shaft and an inner diameter of small piston pipe (11);

a check valve comprising a check valve spring (55), check valve pin (54) and check valve o-ring (56) coupled to one another and with said small piston compression section (7);

an air compression compartment (46) coupled with said small piston compression section (7) via said check valve;

wherein said air compression compartment (46) is configured to hold air from a one or more pumpings each defined by one opening and closing of the upper body with respect to the lower body that compress air into the air compression compartment (46);

wherein during opening of said upper body (1) from said lower body (3) about said joint pin, through application of an opening force, said piston group (4) starts to extend and air begins to compress inside said large piston compression section (6) and is stored in said small piston compression section (7) after passing through said air inlet hole (8) and wherein a distance between said small piston (12) and said small piston shaft (10) increases;

wherein during the closing of upper body (1) with lower body (3) about said joint pin, through application of a closing force, air inside the small piston compression section (7) overcomes the force of check valve spring (55) and pushes the check valve pin (54) and check valve o-ring (56), so that air is compressed into the air compression compartment (46), wherein the air compression process continues until pressure between small piston compression section (7) and air compression compartment (46) is equalized and check valve pin (54) and check valve o-ring (56) return back to their original positions due to the force of check valve spring (55), and wherein an air seal is provided by check valve o-ring (56); and, a discrete value multiple height fore-sight (76) attached to the upper body (1) via a fore-sight pin (77) wherein said discrete value multiple height fore-sight is configured to rotate about a horizontal axis defined as an axis that is orthogonal to a longest dimension of the barrel and rotate in a vertical plane that passes through the discrete value multiple height fore-sight, rear sight and wherein the discrete value multiple height fore-sight remains fixed at a desired discrete position by centering of a fore-sight ball and by a force of a fore-sight spring (79) wherein said discrete value multiple height fore-sight is rotatable to a plurality of discrete heights that each correspond to a particular number of pumpings so that the rear sight does not require adjustment based on the number of pumpings when shooting at a given distance from a target.

2. The high-power pneumatic weapon system of claim 1 further comprising a relief nozzle (48), relief gasket (49), relief piston (50), relief spring (51) and relief adjusting screw (53) coupled to one another and to said lower body (3);

wherein excessive air compressed in said air compression compartment (46) as a result of the one or more of pumpings performed by opening and closing of upper body (1) onto lower body (3), which is determined relief adjusting screw (53) which sets the shooting power, passes through relief nozzle (48) and pushes the relief gasket (49) and the relief spring (51), wherein the relief piston (50) is connected, and after passing through relief adjusting screw (53) and relief spring (51), it is released to outer environment.

3. The high-power pneumatic weapon system of claim 1 further comprising a valve buffer (66) located between valve rod knob (65) and hammer (21), that protects said valve rod knob (65) and said hammer (21) from deformation.

4. The high-power pneumatic weapon system of claim 1 further comprising an output nut (69) carrying barrel o-ring (70) and valve o-ring (68) that are replaceable.

* * * * *